US007500840B2

(12) United States Patent
Zenpo et al.

(10) Patent No.: US 7,500,840 B2
(45) Date of Patent: Mar. 10, 2009

(54) APPARATUS FOR MOLDING A MOLD AND A METAL USED THEREFOR

(75) Inventors: Toshihiko Zenpo, Toyokawa (JP); Yusuke Kato, Toyokawa (JP); Norihiro Asano, Toyokawa (JP); Masahiko Nagasaka, Toyokawa (JP); Kazuyuki Nishikawa, Toyokawa (JP); Motoyasu Tanaka, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 0 days.

(21) Appl. No.: 10/593,591

(22) PCT Filed: Mar. 22, 2005

(86) PCT No.: PCT/JP2005/005126

§ 371 (c)(1),
(2), (4) Date: Sep. 21, 2006

(87) PCT Pub. No.: WO2005/089984

PCT Pub. Date: Sep. 29, 2005

(65) Prior Publication Data

US 2007/0196529 A1 Aug. 23, 2007

(30) Foreign Application Priority Data

Mar. 23, 2004 (JP) ..... 2004-083863
Jan. 19, 2005 (JP) ..... 2005-011507

(51) Int. Cl.
*B29C 44/34* (2006.01)
*B29C 44/58* (2006.01)

(52) U.S. Cl. ..... 425/4 R; 425/140; 425/169; 425/444; 425/450.1; 425/542; 425/546; 425/556; 425/562; 425/817 R

(58) Field of Classification Search ..... 425/4 R, 425/140, 542, 562, 817 R, 449, 436 R, 444, 425/169, 812, 546, 556, 450.1, 451, 451.2
See application file for complete search history.

(56) References Cited

U.S. PATENT DOCUMENTS 2,104,529 A * 1/1938 Rodnick ..... 425/449

(Continued)

FOREIGN PATENT DOCUMENTS

JP 55-54241 4/1980

(Continued)

*Primary Examiner*—Steven P Griffin
*Assistant Examiner*—Seyed Masoud Malekzadeh
(74) *Attorney, Agent, or Firm*—Finnegan, Henderson, Farabow, Garrett & Dunner, L.L.P.

(57) ABSTRACT

An apparatus for molding a mold by pressurizing a foam mixture composed of particles of aggregate, water-soluble binders, and water, and injecting it into a cavity of a heated metal mold that includes a hollow rectangular-parallelepiped body 12 having a bottom plate 14, the bottom plate 14 having an injection hole 13 to inject the foam mixture, a device 10 for containing the foam mixture having functions as a mixing bath to mix particles of aggregate, water-soluble binders, and water, and as a pressurized vessel to inject the foam mixture into the metal mold, and a device 22 for closing and opening the injection hole 13. The apparatus is further provided with a device for measuring a temperature of the particles of aggregate or the foam mixture, the viscosity, and the moisture and a device for communicating gases from the cavity of the metal mold to the outside of the mold so that the particles of aggregate cannot pass through it.

9 Claims, 6 Drawing Sheets

U.S. PATENT DOCUMENTS 2,218,767 A * 10/1940 Pfeifer ..... 425/432
2,637,888 A * 5/1953 Bushore ..... 425/219
2,987,484 A * 6/1961 Lundberg et al. ..... 510/145
3,328,852 A * 7/1967 Ellms ..... 164/201
3,599,282 A * 8/1971 Meyers et al. ..... 425/4 R
3,624,825 A * 11/1971 Heitzman ..... 425/330
3,659,986 A * 5/1972 Gelbman ..... 425/88
3,712,781 A * 1/1973 Schmier ..... 425/161
3,804,568 A * 4/1974 Rees ..... 425/139
3,813,201 A * 5/1974 Frederick et al. ..... 425/562
3,871,801 A * 3/1975 Buchmann ..... 425/4 R
3,929,173 A * 12/1975 Mauroner ..... 141/74
3,992,501 A * 11/1976 Tatzel et al. ..... 264/126
4,028,450 A * 6/1977 Gould ..... 264/45.5
4,036,923 A * 7/1977 Saidla ..... 264/45.3
4,118,165 A * 10/1978 Christian ..... 425/262
4,227,556 A * 10/1980 Hurst et al. ..... 141/137
4,295,810 A * 10/1981 Dennert et al. ..... 425/110
4,448,736 A * 5/1984 Emery et al. ..... 264/40.1
4,557,881 A * 12/1985 Rabotski ..... 264/40.4
4,735,564 A * 4/1988 Sasaki et al. ..... 425/145
4,780,256 A * 10/1988 Sasaki et al. ..... 264/40.1
4,923,666 A * 5/1990 Yamazaki et al. ..... 264/572
4,963,083 A * 10/1990 Stalter et al. ..... 425/125
5,354,194 A * 10/1994 Kresak ..... 425/436 R
5,405,570 A * 4/1995 Fuma et al. ..... 419/2
5,435,967 A * 7/1995 Nishikawa et al. ..... 419/65
5,449,698 A * 9/1995 Mabuchi et al. ..... 521/51
5,603,808 A * 2/1997 Nishikawa ..... 162/382
5,841,041 A * 11/1998 Asano et al. ..... 75/229
6,036,993 A * 3/2000 Frazzitta ..... 427/8
6,227,835 B1 * 5/2001 Bazzica ..... 425/3
6,231,326 B1 * 5/2001 Sisbarro ..... 425/74
6,352,659 B1 * 3/2002 Clark et al. ..... 264/51
6,612,190 B2 * 9/2003 Takeuchi et al. ..... 73/865
6,841,123 B1 * 1/2005 Nabeshima et al. ..... 73/865
6,878,643 B2 * 4/2005 Krulevitch et al. ..... 438/780
7,104,780 B2 * 9/2006 Domodossola et al. ..... 425/534
7,128,564 B2 * 10/2006 Di Simone ..... 425/556
7,264,463 B2 * 9/2007 Domodossola et al. ..... 425/444
2002/0127295 A1 * 9/2002 Padovani ..... 425/388
2003/0107155 A1 * 6/2003 Olaru et al. ..... 264/328.1
2003/0124033 A1 * 7/2003 Baker et al. ..... 422/128
2003/0209094 A1 * 11/2003 Takeuchi et al. ..... 73/865
2006/0071364 A1 * 4/2006 Zenpo et al. ..... 264/219

FOREIGN PATENT DOCUMENTS

JP 56-4342 1/1981
JP 7-80599 3/1995
JP 8-57577 3/1996
JP 10-225745 8/1998
JP 11-129054 5/1999
JP 2000-190049 7/2000

* cited by examiner

APPARATUS FOR MOLDING A MOLD AND A METAL USED THEREFOR

TECHNICAL FIELD

This invention relates to an apparatus for molding a mold by pressurizing a foam mixture composed of particles of aggregate, water-soluble binders, and water, and injecting it into a cavity of a heated metal mold. This invention also relates to a metal mold used in the apparatus.

BACKGROUND OF THE INVENTION

Recently, a method for molding a mold in which water-soluble binders are used as a binder for particles of aggregate and are hardened by heating them and evaporating their water is frequently used because of a good frangible property of the mold after casting.

There is an apparatus for molding such a mold, comprising: a cylinder extending upward and downward, a plunger disposed in the cylinder and sliding upward and downward in the cylinder, and a gate for opening and closing the opening disposed at the bottom of the cylinder, wherein these elements constitute a means for injecting fluid foundry sand into a metal mold. The apparatus can move upward and downward. The apparatus is also connected to a mixer to prepare the fluid foundry sand at the opening disposed at the center of the cylinder.

In this conventional apparatus, an additional gate is disposed at the center of the cylinder, the positions of the gate disposed at the bottom and the center of the cylinder are changed, and the position of the plunger is changed to control the quantity of the fluid foundry sand to be injected into the metal mold. (See patent document 1.) In this conventional apparatus, however, it is difficult to control the quantity of the fluid foundry sand to be injected into the metal mold in order to have it correspond to the cavity of the metal mold. Further, since more fluid foundry sand than can be filled within the cavity of the mold should be loaded in the cylinder, some of the fluid foundry sand remains in the cylinder after it is injected into the cavity of the mold. Since this remainder of the fluid foundry sand is left, it is wasted.

Further, it sometimes occurs that there is not enough, fluid foundry sand in the cylinder to fill the cavity of the metal mold.

Further, since the foam mixture, which is the material for making a mold, contains the water-soluble binders as the binder for the particles of aggregate and contains a large quantity of water, it takes a long time for the foam mixture to be hardened in the metal mold.

Patent document 1: Japanese Patent Laid-open Publication No. S55-54241

Patent document 2: Japanese Patent Laid-open Publication No. H11-129054

DISCLOSURES OF THE INVENTION

The purpose of this invention is to solve the above problems of the conventional apparatus.

An apparatus for molding a mold by pressurizing a foam mixture composed of particles of aggregate, water-soluble binders, and water, and injecting it into a cavity of a heated metal mold, the apparatus comprising:

a hollow rectangular-parallelepiped body having a bottom plate, the bottom plate having an injection hole to inject the foam mixture, a means for containing the foam mixture having functions as a mixing bath to mix particles of aggregate, water-soluble binders, and water, and as a pressurized vessel to inject the foam mixture into a metal mold, and a means for closing and opening the injection hole.

The apparatus is also provided with any means or any combination of means for measuring temperature, viscosity, and moisture.

Further, to solve the problems mentioned above, which occur in the process for molding a mold by using the foam mixture made by mixing the particles of aggregate, more than one kind of water-soluble binders, and water, and a metal mold for molding a mold by being filled with the foam mixture, is provided with a means for communicating gases from the cavity of the metal mold to the outside of the mold so that the particles of aggregate cannot pass through it.

By using this apparatus for molding a mold, the mold is made based on the following steps:

a closing step to close the injection hole by the means for closing and opening the injection hole, a mixing step to mix a predetermined quantity of the particles of aggregate, the water-soluble binders, and the water contained in the means for containing the foam mixture, wherein the predetermined quantity is more than the quantity that can be held within the cavity of the metal mold, a connecting step to connect the means for containing the foam mixture to the heated metal mold after mixing, and an injecting step to inject the foam mixture into the cavity of the metal mold by pressurizing the mixture.

Then, the particles of aggregate, the water-soluble binders, and the water are poured in the means for containing the foam mixture and are mixed for the next process for molding a mold.

As mentioned above, since the apparatus is at least provided with any means or any combination of means for measuring the temperature of the particles of aggregate or the foam mixture, or the viscosity of the foam mixture, or the moisture of the foam mixture, when the temperature of the particles of aggregate or the foam mixture is too high, it is possible to control the temperature of a heater. Further, when the viscosity of the foam mixture is too low, water can be added to it from a means for providing water, and then the foam mixture is further mixed, and when the moisture of the foam mixture is too low, water can also be added to the foam mixture from the means for providing the water, and the foam mixture is further mixed. Thus, the cavity of the metal mold can be filled with a foam mixture having proper properties.

By using the metal mold mentioned above, the steam generated from the foam mixture when the metal mold is heated can be released by passing it through the means for communicating gases from the cavity of the metal mold to the outside of the mold.

As explained above, the apparatus according to the present invention has the following constitution:

an apparatus for molding a mold by pressurizing a foam mixture composed of particles of aggregate, water-soluble binders, and water, and injecting it into a cavity of a heated metal mold, the apparatus comprising:

a hollow rectangular-parallelepiped body having a bottom plate, the bottom plate having an injection hole to inject the foam mixture, a means for containing the foam mixture having functions as a mixing bath to mix particles of aggregate, water-soluble binders, and water, and as a pressurized vessel to inject the foam mixture into a metal mold, and a means for closing and opening the injecting hole.

Since the mold may be made by using this apparatus based on the following steps:

an adding step to add the particles of aggregate, the water-soluble binders, and the water to the means for containing the foam mixture, after filling the cavity of the metal mold with the foam mixture contained in the means for containing the foam mixture, and then a mixing step to mix the particles of aggregate, the water-soluble binders, and the water to cause them to foam, the foam mixture which remains in the means for containing it after injecting the mixture into the cavity of the metal mold can be used effectively at the next steps for making a mold.

Thus, while in the conventional apparatus the remaining foam mixture in the means for containing the foam mixture is not recovered, the apparatus according to this invention has an excellent effect because the remainder can be used effectively.

Further, since the apparatus is provided with any means or any combination of means for measuring the temperature of the particles of aggregate or the foam mixture, the viscosity of the foam mixture, or the moisture of the foam mixture, when the temperature of the particles of aggregate or the foam mixture is too high, it is possible to control the temperature of a heater, and when the viscosity of the foam mixture is too low, water can be added to the foam mixture from a means for providing water, and then the foam mixture is further mixed, and when the moisture of the foam mixture is too low, water can also be added to the foam mixture, and then the foam mixture is further mixed. Thus, the cavity of the metal mold can be filled with a foam mixture having proper properties.

Further, in the apparatus for molding a mold by using the foam mixture made by mixing the particles of aggregate, more than one kind of the water-soluble binders, and water, and using the metal mold, since the metal mold for molding a mold by filling it with the foam mixture is provided with the means for communicating gases from the cavity of the metal mold to the outside of the mold so that the particles of aggregate cannot pass through it, the steam generated from the foam mixture can be released by passing it through the means for communicating gases. Thus, the metal mold according to this invention has an excellent effect because the period for hardening the foam mixture can be significantly reduced.

BRIEF DESCRIPTIONS OF THE DRAWINGS

PREFERRED EMBODIMENTS OF THE INVENTION

Some of the embodiments of this invention for an apparatus for molding a mold are now explained in detail based on the figures.

Figure 1:
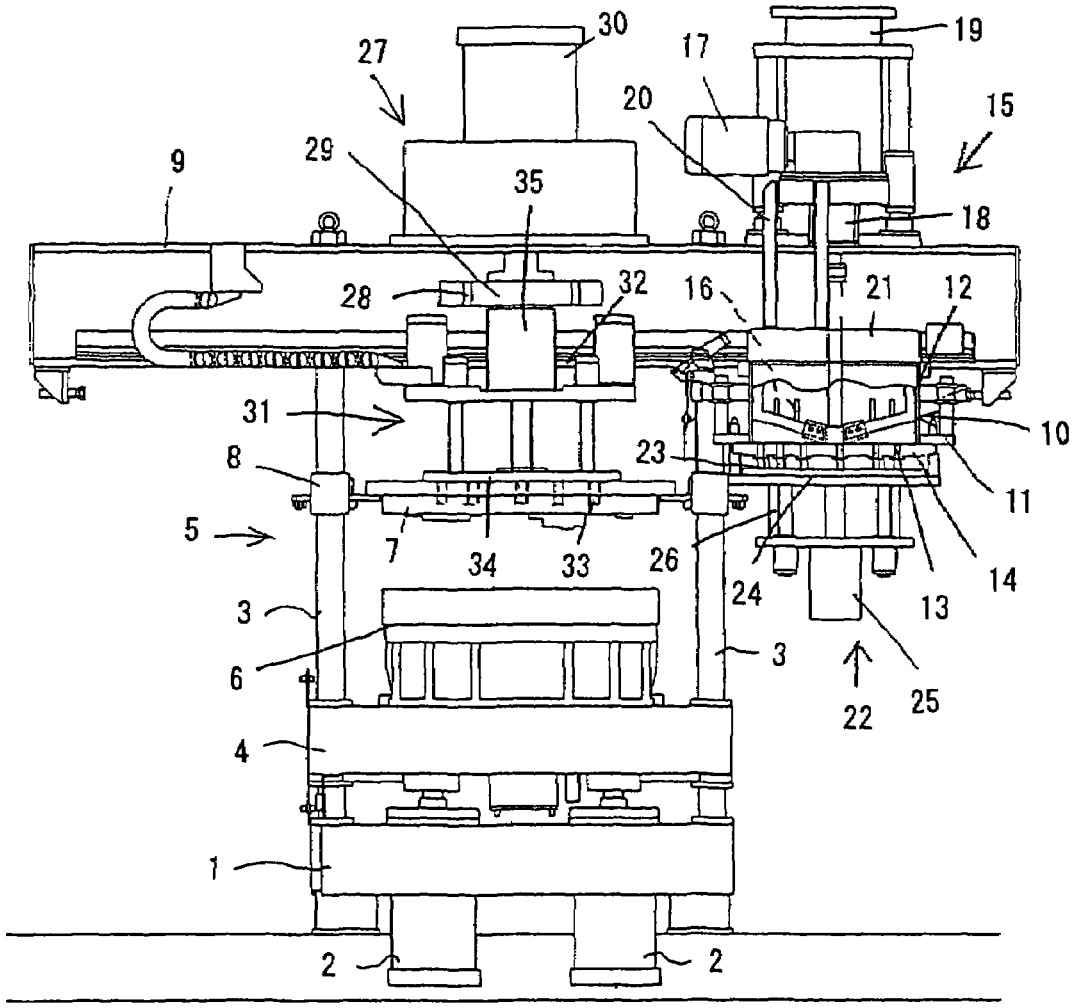
FIG. 1 shows an elevation view and a partial section view of an apparatus for molding a mold of a preferred embodiment of the invention.
Figure 2:
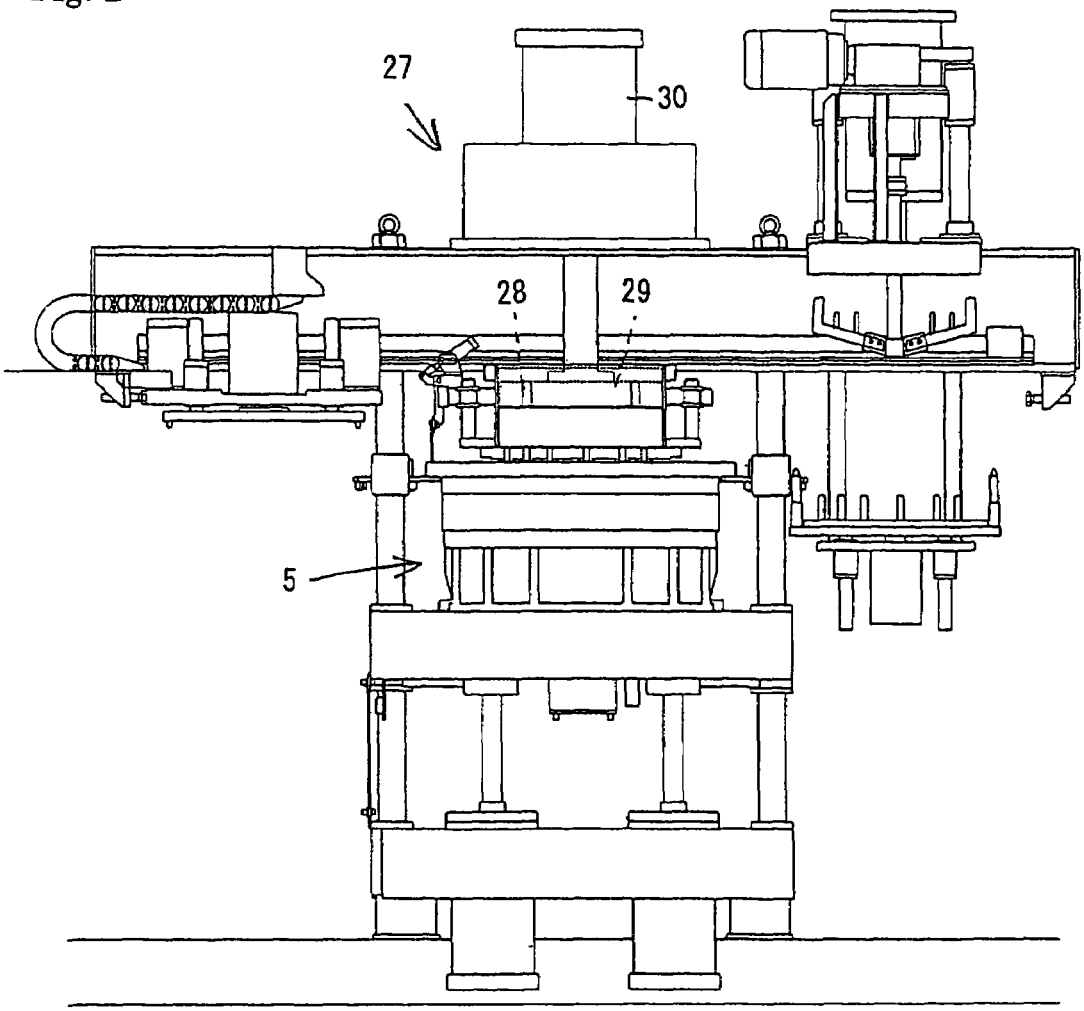
FIG. 2 shows a drawing to explain the operations of the apparatus for molding a mold, indicating the state wherein the mixture in the means for containing the foam mixture is injected into the horizontally separated metal mold.
Figure 3:
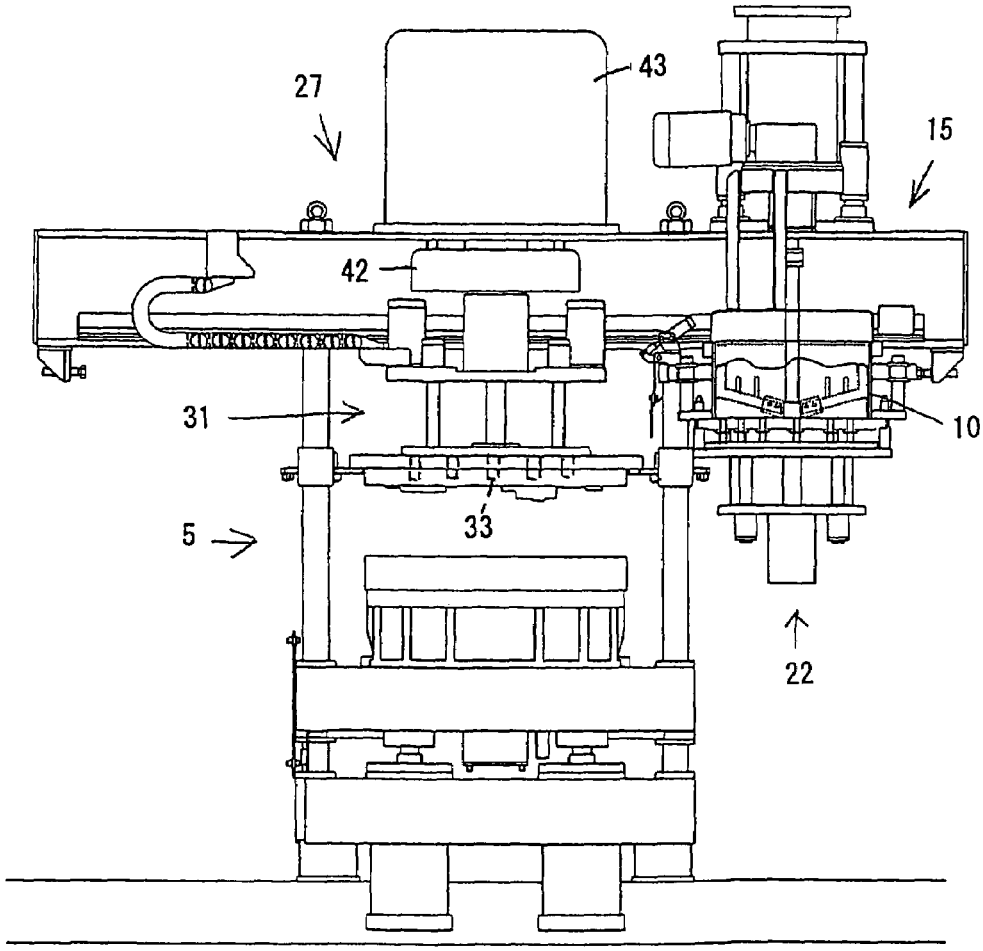
FIG. 3 shows an elevation view and a partial section view of an apparatus for molding a mold of an embodiment of the invention.

As shown in FIGS. 1 and 2, the apparatus is provided with the base 1 having two cylinders 2, 2 arranged vertically, and four guide rods 3, 3 disposed at the four corners of the base 1. A lifting and lowering frame 4 is disposed at the top of the piston rods of the two cylinders 2, 2 and is slidably connected to the four guide rods 3, 3 so that the lifting and lowering frame 4 can be lifted and lowered. A lower part 6 of a horizontally separated metal mold 5 is disposed on the lifting and lowering frame 4. An upper part 7 of the horizontally separated metal mold 5 is disposed above the lower part 6 by being connected to support mechanisms slidably connected to the guide rods 3, 3.

An upper frame 9 is disposed on the top of the four guide rods 3, 3 and extends in the right and left directions. A means 10 for containing the foam mixture having functions as a mixing bath and a pressurized vessel is disposed at the right side of the lower surface of the upper frame 9 through a first carriage 11 so that the means 10 can move right and left.

The means 10 for containing the foam mixture has a hollow rectangular-parallelepiped body 12 having a bottom plate 14, which closes the openings of the bottom of the body 12, having a plurality of injection holes 13, 13 to inject the foam mixture. The bottom plate 14 has a water cooling structure on its upper surface and has a thermal insulator at its lower surface.

Further, a mixing fan mechanism 15 is disposed at the right side of the upper surface of the upper frame 9 to mix the particles of aggregate, the water-soluble binders, and the water in the means 10 for containing the foam mixture so that the mixture foams. The mixing fan 16 of the mixing fan mechanism 15 is connected to a drive shaft of a motor 17 through a power transmission 18. The motor 17 is mounted on support members 20, which can be lifted and lowered by driving a cylinder 19 arranged vertically and disposed on the upper frame 9. A cover 21 is disposed at the support members 20 to close an opening of the upper surface of the means 10 for containing the foam mixture. The mixing fan 16 and the cover 21 can be lifted and lowered by driving the cylinder 19.

Further, a means 22 for closing and opening the injecting holes 13, 13 is disposed under the mixing fan mechanism 15 disposed at the upper frame 9. A plurality of plugs 23, 23, which can be inserted into the injection holes 13, 13, of the means 22 for closing and opening the injecting holes, are disposed at an upper part of a piston rod of a cylinder arranged vertically through a support plate 24. The plugs 23, 23 can be moved upward and downward by driving the cylinder 25. The cylinder 25 is disposed at the upper frame 9 through support members 26, 26. The injection holes 13, 13 can be cleaned by inserting the plurality of the plugs 23, 23 into them.

A pressurizing mechanism 27 is disposed above the horizontally separated metal mold 5 and on the upper frame 9 to inject the foam mixture contained in the means 10 for containing the foam mixture from the injection holes 13, 13 of the means 10. The pressurizing mechanism 27 has a piston 29 having a plurality of exhaust holes 28, 28 communicating from a lower to an upper surface of the piston 29. The piston 29 can be moved upward and downward by driving a cylinder 30 arranged vertically.

A mechanism 31 for pushing a mold out is disposed at the left side of the under surface of the upper frame 9 through a second carriage 32 to push the mold from the upper part 7 so that the mechanism 31 can be moved left and right. A plurality of pins 33, 33 for pushing a mold out are disposed at the lower part of a piston rod of a cylinder 35 arranged vertically through a pushing plate 34. The plurality of pins 33, 33 for pushing a mold out can be moved upward and downward by driving the cylinder 35.

It is also possible to measure the temperature of the particles of aggregate or the foam mixture by a contact- or noncontact-type thermo-sensor (not shown) disposed in the means 10 for containing the foam mixture or outside the means 10.

It is also possible to place a sensor (not shown) for measuring the viscosity of the foam mixture in the means 10 for containing the foam mixture or outside the means 10.

There are several kinds of sensors for measuring the viscosity of the foam mixture, such as:

(1) A type of a sensor that presses and inserts a probe: a method for measuring the relative viscosity of the foam mixture by measuring a load (a reaction force) when the top, which has a spherical or a cylindrical configuration, of the probe is press fitted into the foam mixture.

(2) A type of a sensor that presses, inserts, and rotates a probe: a method for measuring the relative viscosity of the foam mixture by measuring a load (a torque) when the top, which has a part of a fan or a fan integrated with it, of the probe is inserted into the foam mixture and is then rotated.

(3) A type of a sensor that rotates a probe: a method for measuring the relative viscosity of the foam mixture by measuring a load (a reaction force and a torque) when the top, which has a spherical or a cylindrical configuration, of the probe is rotated in the foam mixture while the probe is press fitted into the foam mixture.

(4) A type of a sensor that measures apparent viscosity: a method for measuring the relative viscosity of the foam mixture by measuring the flow rate of the foam mixture flowing from an opening of a cylindrical structure, which contains the foam mixture and is provided with an opening having a predetermined diameter, when the foam mixture is pressurized.

It is possible to measure the viscosity of the foam mixture continuously or by every batch.

Further, it is possible to place a sensor (not shown) for measuring the moisture of the foam mixture in the means 10 for containing the foam mixture or outside the means 10. There are a few kinds of the sensor for measuring moisture, such as a sensor for measuring the electrical resistance of the foam mixture, and a sensor for measuring the weight loss of the foam mixture when the moisture in the mixture is evaporated by heating the foam mixture.

Next, the process to make a mold by using the apparatus according to the invention is now explained.

As shown in FIG. 1, after the injection holes 13, 13 are closed by the plugs 23, 23 of the means 22 for closing and opening the injecting holes, then, for example, silica sand as the particles of aggregate, polyvinyl alcohol as the water-soluble binders, and water are loaded in the means 10 for containing the foam mixture, and then the opening of the upper surface of the means 10 is closed by the cover 21.

Then, the silica sand, the polyvinyl alcohol, and the water are mixed by rotating the mixing fan 16 by driving the motor 17 of the mixing fan mechanism 15 so that the mixture foams. Next, the mixing fan 16 and the cover 21 are lifted by driving the cylinder 19 of the mixing fan mechanism 15, and then the injection holes 13, 13 are opened by pulling out the plugs 23, 23 of the means 22 for closing and opening the injecting holes by driving the cylinder 25 of the means 22 for closing and opening the injecting holes.

Then, the mechanism 31 for pushing a mold out and the means 10 for containing the foam mixture are moved to the left side of the upper frame 9 by means of the second carriage 32 and the first carriage 11 respectively, and the means 10 is moved above the horizontally separated metal mold 5 heated by the heater. The lower part 6 of the horizontally separated metal mold 5 is lifted by means of the lifting and lowering frame 4 by driving the cylinders 2, 2, and the upper part 7 is placed on the lower part 6. The means 10 is also placed on the upper part 7, and then the lower surface of the means 10 contacts the upper surface of the upper part 7.

Next, as shown in FIG. 2, the piston 29 is lowered by driving the cylinder 30 of the pressurizing mechanism 27. After the air between the piston 29 and the foam mixture is exhausted through the exhaust holes 28, 28 while the piston 29 is lowered, the upper opening of the exhaust holes 28, 28 is closed by a means for closing the exhaust holes (not shown), and then the foam mixture in the means 10 for containing the foam mixture is injected into the cavity of the horizontally separated metal mold 5 by pressurizing the foam mixture. The foam mixture injected into the cavity is hardened because the moisture in the mixture is evaporated by heating the mixture with the heat in the metal mold 5.

After injecting the foam mixture into the horizontally separated metal mold 5, the piston 29 is lifted by driving the cylinder 30, and the mechanism 31 for pushing a mold out and the means 10 for containing the foam mixture are moved to the right side of the upper frame 9 by means of the second carriage 32 and the first carriage 11 respectively. The mechanism 31 is placed above the horizontally separated metal mold 5, and then the means 10 for containing the foam mixture is placed below the mixing fan mechanism 15.

Then, the pins 33, 33 for pushing a mold out are inserted into the upper part 7 of the horizontally separated metal mold 5 by driving the cylinder 35 of the mechanism 31 for pushing a mold out, and the lower part 6 is lowered by driving the cylinders 2, 2. The mold is separated from the upper part 7, and then the mold is pushed out from the lower part 6 by the mechanism for pushing the mold out (not shown).

The means 10 for containing the foam mixture that was moved to below the mixing fan mechanism 15 is filled with the additional silica sand, polyvinyl alcohol, and water for the next step for making the mold.

The quality control of the foam mixture is very important to produce a mold having excellent qualities by using the apparatus for molding a mold according to the invention. A method for controlling the quality of the mold is now explained in detail.

When the mold is produced by injecting the foam mixture, which is made by mixing the particles of aggregate, water-soluble binders, and water so that the mixture foams, into the cavity of the metal mold heated by the heater by means of the pressurizing method, the following method for controlling the quality of the foam mixture can be used to produce a mold having excellent properties:

a first process for determining the basic values of the viscosity and the moisture of the foam mixture based on measurements of the temperature of the foam mixture, a second process for comparing the basic values of the viscosity and moisture of the foam mixture with the measured viscosity of the foam mixture, a third process for comparing the basic values of the viscosity and moisture of the foam mixture with the measured moisture of the foam mixture, if there is no problem in the result of the second process, and a fourth process for determining that the foam mixture has proper properties, if there is no problem in the result of the third process.

In this quality control of the foam mixture, if the viscosity of the foam mixture differs from the basic value of the viscosity in the second process, the viscosity of the foam mixture may be controlled by mixing the mixture again.

In this quality control, further, if the moisture of the foam mixture differs from the basic value of the moisture in the third process, the moisture of the foam mixture may be controlled by adding water and mixing the mixture again.

In this quality control, it is possible to measure the temperature of the foam mixture by using a noncontact-type thermo-sensor.

Further, in this quality control, it is possible to measure the viscosity of the foam mixture by using the type of a sensor that presses and inserts a probe, or the type of a sensor that presses, inserts, and rotates a probe, or the type of a sensor that rotates a probe.

In this quality control, it is possible to measure the moisture of the foam mixture by measuring its electrical resistance.

Further, in this quality control, it is possible to measure the temperature, the viscosity, and moisture by sampling every batch of the foam mixture.

Further, in this quality control, it is possible to continuously measure the temperature, the viscosity, and moisture by installing the sensors in the mixer.

Figure 4:
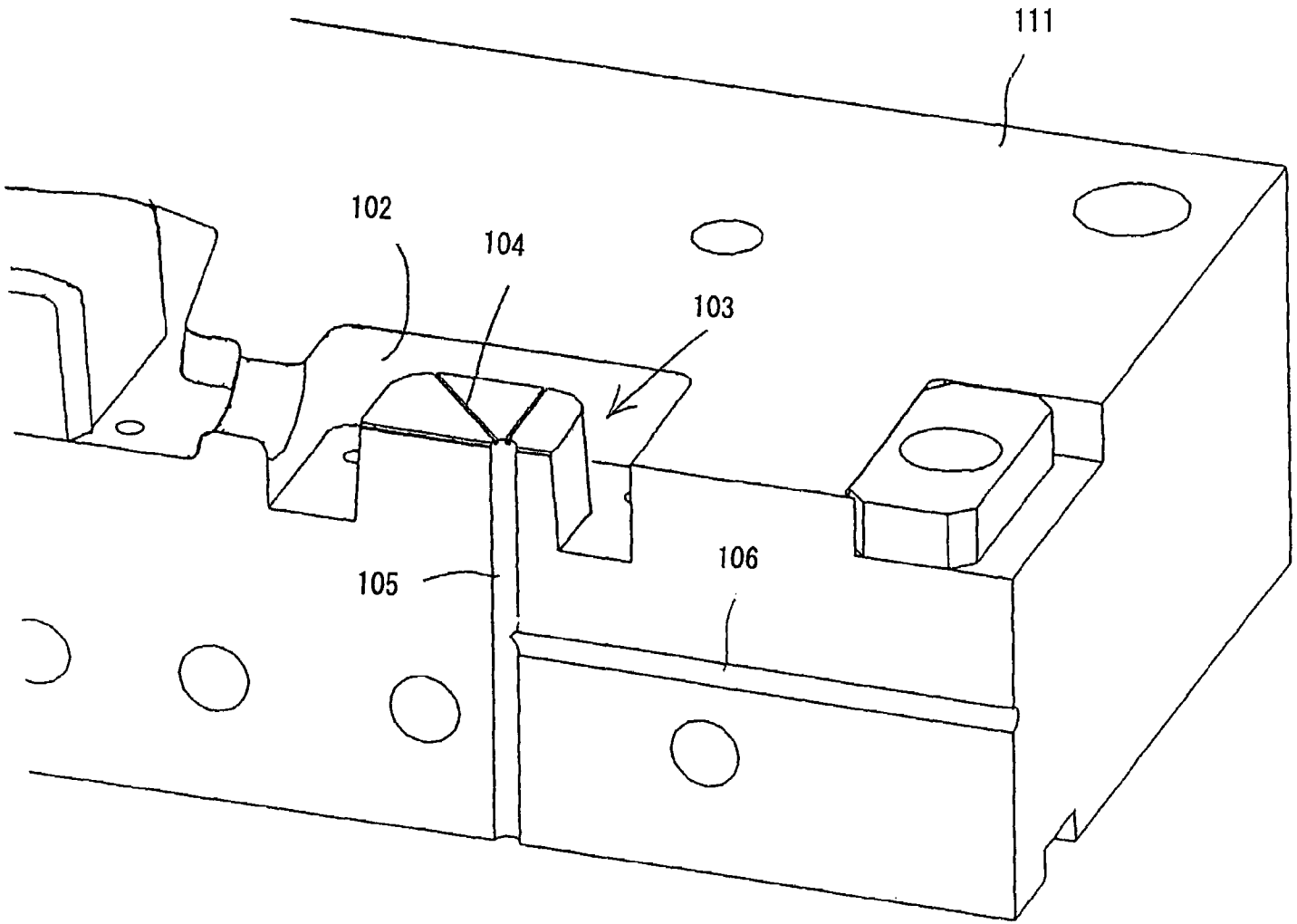
FIG. 4 shows a part of the lower part of the metal mold.

Some of the embodiments of this invention for a metal mold are now explained in detail based on FIG. 4.

A lower part 111 of a horizontally separated metal mold is provided with a means 103 for communicating with the outside of the metal mold from the cavity 102 of the metal mold at the upper surface of the inner part in the cavity of the lower part 111. The means 103 for communicating with the outside is comprised of a plurality of radial grooves 104, 104 disposed at the upper surface of the inner part in the cavity 102, a first communicating hole 105 penetrating the lower part 111 from the upper surface to the lower surface of the lower part 111 and communicating with the plurality of the grooves 104, 104 at the upper surface of the lower part 111, and a second communicating hole 106 communicating with the first communicating hole 105 at the left end and extending to the right outer side of the lower part 111.

Since the metal mold has the constitution mentioned above, when the foam mixture in the cavity 102 is heated, the steam generated from the foam mixture is released through the means 103 for communicating with the outside of the metal mold.

In the preferred embodiment mentioned above, although the means 103 for communicating with the outside of the metal mold is comprised of the plurality of the radial grooves 104, 104 disposed at the upper surface of the inner part in the cavity 102, the first communicating hole 105 penetrating the lower part 111 from the upper surface to the lower surface of the lower part 111 and communicating with the plurality of the grooves 104, 104 at the upper surface of the lower part 111, and the second communicating hole 106 communicating with the first communicating hole 105 at the left end and extending to the right outer side of the lower part 111, the constitution of the means 103 is not limited to this constitution.

Figure 5:
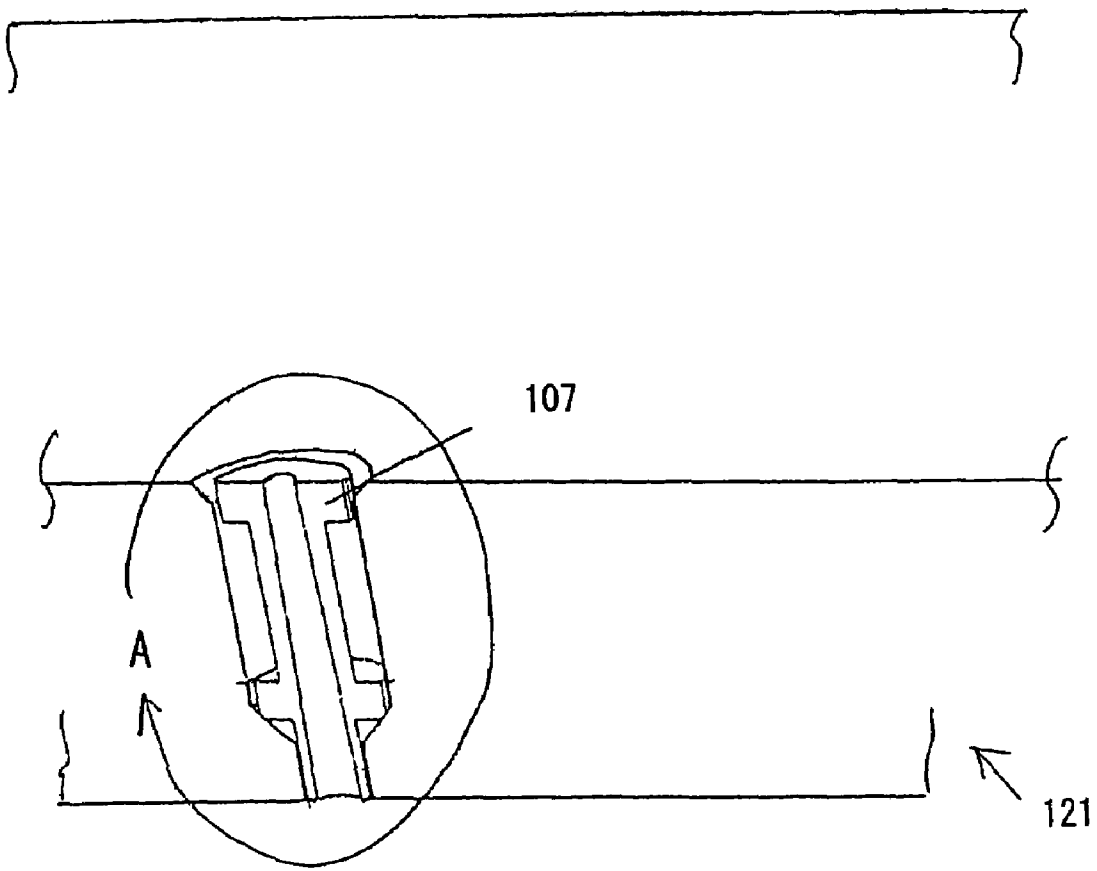
FIG. 5 shows a perspective view of the metal mold of an embodiment of the invention.

For example, as shown in FIG. 5, it is possible to use the gap between the upper part 121 of the horizontally separated metal mold and the part 107, which is inserted in the upper part 121, for injecting the foam mixture into the cavity 102, as a means for communicating with the outside of the metal mold. Further, it is possible to use the gap between the holes (not shown), in which the pins are inserted, and to penetrate the upper part 121 of the horizontally separated metal mold and the pins (not shown) of the mechanism 31 for pushing a mold out, as means for communicating with the outside of the metal mold.

Figure 6:
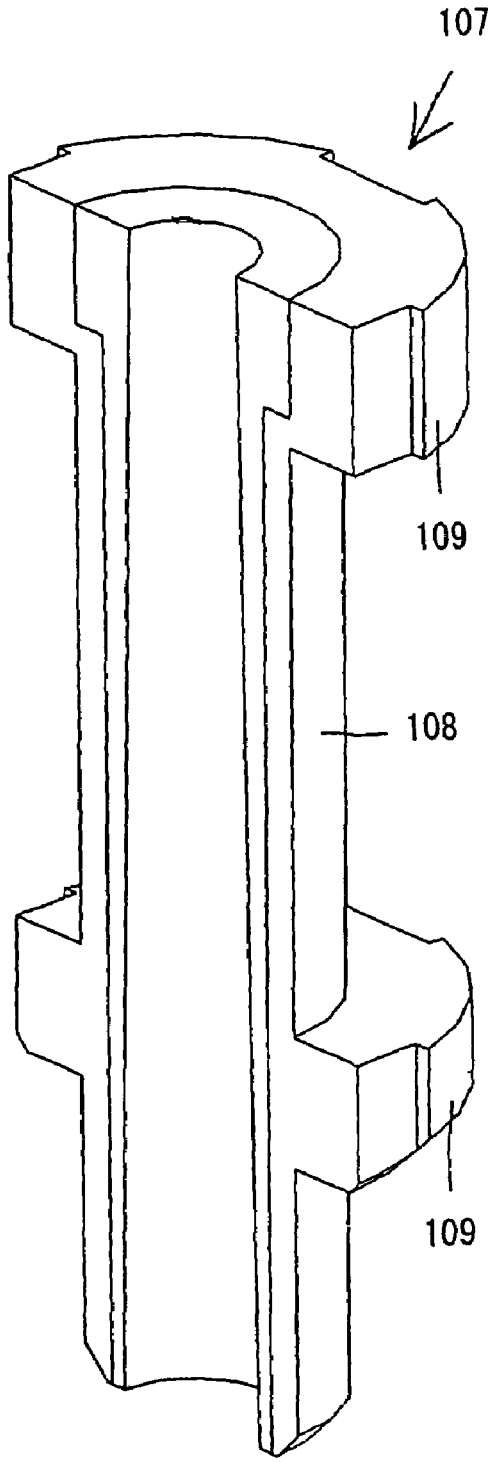
FIG. 6 shows an enlarged and detailed view of the part "A" of FIG. 5.

As shown in FIG. 6, the part 107 for injecting the foam mixture into the cavity 102 may be provided with the flanges 109, 109 protruding from the cylindrical body 108 at the top and the center of the body 108 to form a relatively wide space between the cylindrical body 108 of the part 107 and the upper part 121 when the part 107 is inserted in the upper part 121.

Since this constitution of the part 107 can reduce the thermal conduction from the upper part 121 heated by a heater to the cylindrical body 108 of the part 107 for injecting the foam mixture into the cavity 102, it is possible to keep the temperature of the cylindrical body 108 of the part 107 lower than that of the upper part 121.

On the other hand, the amount of the foam mixture in the cylindrical body 108 of the part 107 is less than that in the upper part 121. Thus, it is possible to harden the foam mixture in the cylindrical body 108 and in the upper part 121 at the same rate by controlling the temperature of the cylindrical body 108 to be lower than that of the upper part 121.

Therefore, the problem of the foam mixture in the cylindrical body 108 being overheated can be solved.

What we claim is:

1. An apparatus for molding a mold by pressurizing a foam mixture and injecting it into a cavity of a heated metal mold, the apparatus comprising:

a base, a plurality of cylinders having piston rods arranged vertically and disposed on the base, four guide rods disposed at four respective corners of the base, a lifting and lowering frame disposed at tops of the piston rods of the cylinders, and slidably connected to the four guide rods so that the lifting and lowering frame can be lifted and lowered by the cylinders and guided by said rods, a horizontally separable heated metal mold having a cavity, a lower part of the horizontally separable metal mold being disposed on the lifting and lowering frame, and an upper part of the horizontally separable metal mold being connected to a support mechanism slidably connected to the guide rods, an upper frame disposed on tops of the four guide rods, and extending in right and left directions, a means for containing a foam mixture having the function of a mixing bath to mix the foam mixture, and acting as a pressurizable vessel for injecting the foam mixture into the cavity of the metal mold, the means for containing the foam mixture having a hollow rectangular-parallelepiped body having a bottom plate, the bottom plate having a hole through which the foam mixture can be injected, a mixing fan mechanism disposed on the upper frame, which upper frame is located above the means for containing the foam mixture, wherein the mixing fan mechanism has a mixing fan and can be lifted and lowered by a cylinder so that the mixing fan of the mechanism can be moved into and out of the means for containing the foam mixture, a means for closing and opening the hole of the bottom plate, a first carriage for moving the means for containing the foam mixture to a position above the upper part of the metal mold, a pressurizing mechanism for pressurizing the foam mixture in the means for containing the foam mixture to inject the foam mixture into the cavity of the metal mold through the hole in the bottom plate to form a mold in the cavity, a mechanism for pushing the mold out of the metal mold having pins for pushing the mold out, which pins are inserted into the upper part of the metal mold after molding the mold in the metal mold, and a second carriage for moving the mechanism for pushing the mold out from a position above the metal mold to a position apart from the metal mold.

2. The apparatus according to claim 1, further including a means for measuring a temperature of particles of aggregate of the foam mixture or of the foam mixture, and a means for measuring a moisture content of the foam mixture.

3. The apparatus according to claim 2, further including a means for measuring a viscosity of the foam mixture.

4. The apparatus according to either claim 2 or 3, wherein the means for measuring the temperature is a contact- or noncontact-type thermo-sensor and is disposed in the means for containing the foam mixture or outside of the means for containing the foam mixture.

5. The apparatus according to claim 3, wherein the means for measuring the viscosity is any one of:

a sensor that presses and inserts a probe for measuring viscosity by measuring a load when a top of the probe is press fitted into the foam mixture, a sensor that rotates a probe for measuring viscosity by measuring a load when a top of the probe is rotated in the foam mixture, a sensor that presses, inserts, and rotates a probe for measuring viscosity by measuring a load when a top of the probe is inserted in the foam mixture and is then rotated in the foam mixture, and a sensor that measures apparent viscosity by measuring a flow rate of the foam mixture flowing from an opening of a cylindrical structure when the foam mixture is pressurized.

6. The apparatus according to claim 5, wherein the means for measuring the viscosity is disposed in the means for containing the foam mixture or outside of the means for containing the foam mixture.

7. The apparatus according to claim 5, wherein the means for measuring the viscosity of the foam mixture measures continuously or measures each batch of the foam mixture.

8. The apparatus according to either claim 2 or 3, wherein the means for measuring the moisture content is either a sensor for measuring an electrical resistance of the foam mixture, or a sensor for measuring a weight loss of the foam mixture when the moisture is evaporated by heating the foam mixture.

9. The apparatus according to claim 1, further including a means for communicating gases from the cavity of the metal mold to an outside of the mold.

* * * * *